US006729926B2

(12) United States Patent
Murao et al.

(10) Patent No.: US 6,729,926 B2
(45) Date of Patent: May 4, 2004

(54) METHOD FOR MAKING MAGNETRONS

(75) Inventors: Noriyuki Murao, Hyogo-ken (JP); Kazuki Miki, Himeji (JP); Satoshi Nakai, Kasai (JP); Setsuo Hasegawa, Kasai (JP); Noriyuki Okada, Hyogo-ken (JP)

(73) Assignee: Sanyo Electric Co., Ltd., Osaka (JP)

( * ) Notice: Subject to any disclaimer, the term of this patent is extended or adjusted under 35 U.S.C. 154(b) by 127 days.

(21) Appl. No.: 10/020,766

(22) Filed: Dec. 12, 2001

(65) Prior Publication Data

US 2002/0081934 A1 Jun. 27, 2002

(30) Foreign Application Priority Data

Dec. 22, 2000 (JP) ..... 2000-390962

(51) Int. Cl.[7] ..... H01J 9/14
(52) U.S. Cl. ..... 445/35; 445/43; 219/91.23
(58) Field of Search ..... 445/35, 43, 44, 445/23, 6, 31; 219/91.23, 93, 121.13, 121.14; 228/175, 164

(56) References Cited

U.S. PATENT DOCUMENTS 3,610,870 A * 10/1971 Sakamoto ..... 219/93
4,495,397 A * 1/1985 Opprecht et al. ..... 219/93
4,650,951 A * 3/1987 Koga et al. ..... 219/91.2
5,073,693 A * 12/1991 Kikuchi et al. ..... 219/93
5,168,142 A * 12/1992 Gartner et al. ..... 219/93
6,037,559 A * 3/2000 Okabe et al. ..... 219/91.23

FOREIGN PATENT DOCUMENTS

| | | | |
|---|---|---|---|
| JP | 60 117527 | 6/1985 | ..... H01J/23/14 |
| JP | 63 146326 | 6/1988 | ..... H01J/23/14 |
| JP | 02 061933 | 1/1990 | ..... H01J/9/14 |
| JP | 05 275019 | 10/1993 | ..... H01J/23/027 |
| JP | 2002-197984 | * 7/2002 | ..... H01J/23/12 |

* cited by examiner

*Primary Examiner*—Dean Reichard
*Assistant Examiner*—Angel R. Estrada
(74) *Attorney, Agent, or Firm*—Darby & Darby

(57) ABSTRACT

A magnetron has an anode cylinder, a plurality of vanes arranged radially within the anode cylinder, a magnetic piece disposed at an open end section of the anode cylinder, an anode vacuum container including a metal container disposed to cover an upper surface of the magnetic piece, a cathode disposed along a central axis of the vacuum container, and an antenna externally discharging microwaves. The magnetic piece and the metal container are placed, in that order, on a shelf formed inwardly on a thin end section projecting from the open end section of the anode cylinder. When tightly welding the thin end section, a predetermined number of projections, projecting inwardly from the thin end section of the anode cylinder, loosely secure an outer perimeter bend of the metal container. The metal container is then accurately tightly welded to the anode cylinder without the metal container shifting off-center.

18 Claims, 5 Drawing Sheets

PRIOR ART

METHOD FOR MAKING MAGNETRONS

BACKGROUND OF THE INVENTION

The present invention relates to a method for making magnetrons. More specifically, the present invention relates to a method for making magnetrons used in radars, microwave heating devices, e.g., microwave ovens, or the like.

Referring to FIG. 4, a conventional magnetron includes a plurality of vanes 52 formed within a cylindrical anode cylinder 51. An anode vacuum container 55 includes a magnetic piece 53 and a metal container 54 disposed at the open end section of the anode cylinder 51. A cathode 57, disposed along the center axis of vacuum container 55, includes a top hat 56*a*, an end hat 56*b*, and a filament 56*c*. An antenna 58 extracts a microwave, e.g., at 2450 MHZ, generated in the hollow space. In this magnetron, the thermoelectrons discharged by filament 56*c* spin inside the active space formed between vanes 52 and filament 56*c*, generating a microwave. This microwave, flowing along a vane 52, is transferred to antenna 58 connected to vain 52. The microwave is then discharged externally through antenna 58.

Anode cylinder 51 and metal container 54 are bonded by tightly welding thin end section 59 of anode cylinder 51. Referring to FIG. 5(*a*), before the welding operation, thin end section 59 of anode cylinder 51 has a roughly even thickness between end 59*a* and base section 59*b*. Magnetic piece 53 and metal container 54 are placed on an inner shelf 60 of thin end section 59.

Referring to FIGS. 4 and 5(*b*), thin end section 59 of anode cylinder 51 is melted by welding to form a tight bond with outer perimeter bend 54*a* of metal container 54.

If a slight gap forms between the inner wall surface of thin end section 59 of anode cylinder 51 and outer perimeter bend 54*a* of metal container 54 due to dimensional tolerances, misalignment of the parts, or the like, this gap will remain, even after the tight welding. This can lead to reduced sealing properties. Discarding such assemblies results in increases material costs, while performing repairs of these assemblies increases the number of steps involved in the procedure.

To prevent these gaps, the parts may be formed with shapes that provide alignment relative to each other. If alignment between the parts is not possible, dedicated tools or equipment may be used to secure the parts while welding. However, with each of these methods there is an increase in production costs.

OBJECTS AND SUMMARY OF THE INVENTION

It is an object of the present invention to provide a method for making a magnetron which overcomes the foregoing problems.

More specifically, it is an object of the present invention to provide a method for making magnetrons that easily improves the quality of the tight welding operation.

Briefly stated, the present invention provides a magnetron having an anode cylinder, a plurality of vanes arranged radially within the anode cylinder, a magnetic piece disposed at an open end section of the anode cylinder, an anode vacuum container including a metal container disposed to cover an upper surface of the magnetic piece, a cathode disposed along a central axis of the vacuum container, and an antenna externally discharging microwaves. The magnetic piece and the metal container are placed, in that order, on a shelf formed inwardly on a thin end section projecting from the open end section of the anode cylinder. When tightly welding the thin end section, a predetermined number of projections, projecting inwardly from the thin end section of the anode cylinder, loosely secure an outer perimeter bend of the metal container. The metal container is then accurately tightly weld to the anode cylinder without the metal container shifting off-center.

According to an embodiment of the present invention, a method for making magnetrons includes a magnetron having an anode cylinder, a plurality of vanes arranged radially within the anode cylinder, a magnetic piece disposed at an open end section of the anode cylinder, an anode vacuum container including a metal container disposed to cover an upper surface of the magnetic piece, a cathode disposed along a central axis of the vacuum container, and an antenna externally discharging microwaves. The magnetic piece and the metal container are placed, in that order, on a shelf formed inwardly on the thin end section projecting from the open end section of the anode cylinder. When tightly welding the thin end section, a predetermined number of projections projecting inwardly from the thin end section of the anode cylinder is used to loosely secure an outer perimeter bend of the metal container.

According to another embodiment of the present invention, a method for making magnetrons includes providing a magnetron having an anode cylinder, a plurality of vanes arranged radially within the anode cylinder, a magnetic piece disposed at an open end section of the anode cylinder, an anode vacuum container including a metal container disposed to cover an upper surface of the magnetic piece, a cathode disposed along a central axis of the vacuum container, and an antenna externally discharging microwaves. The magnetic piece and the metal container are placed, in that order, on a shelf formed inwardly on the thin end section projecting from the open end section of the anode cylinder. When tightly welding the thin end section, a ring-shaped projection, projecting inward from the thin end section of the anode cylinder, is used to loosely secure an outer perimeter bend of the metal container.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 2(*b*) is a schematic cross-section drawing showing a magnetron, according to the present invention, after elements are loosely secured.

FIG. 3(*b*) is shows a state of a magnetron, according to another embodiment of the present invention, after elements are loosely secured.

FIG. 5(*b*) is a cross-section drawing of a conventional magnetron after tight welding is performed.

DETAILED DESCRIPTION OF THE PREFERRED EMBODIMENTS

Referring to the attached drawings, the following is a description of a method for making magnetrons according to the present invention.

Figure 1:
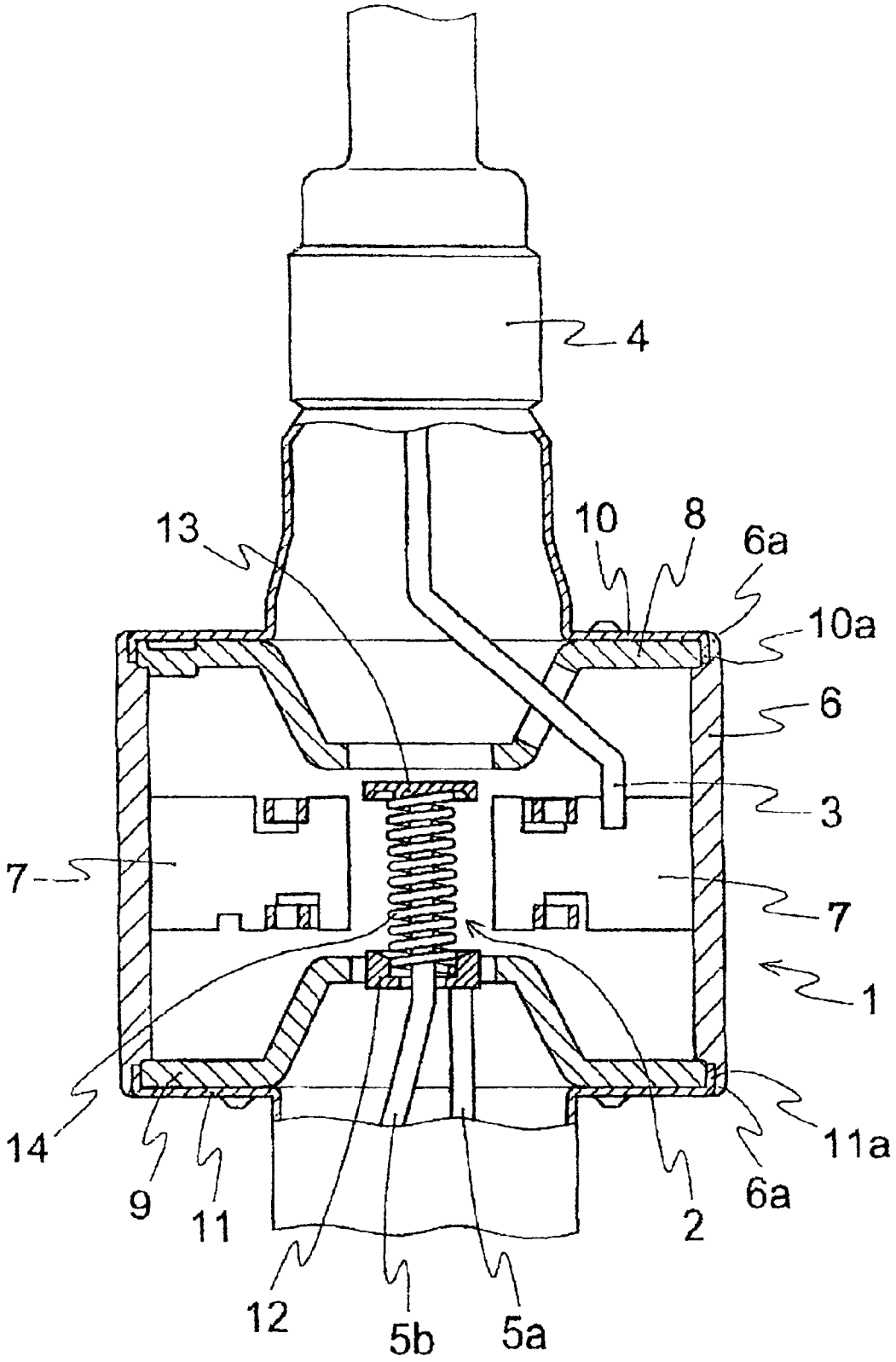
FIG. 1 is a schematic cross-section drawing showing an embodiment of a magnetron according to the present invention.

Referring to FIG. 1, a magnetron according to an embodiment of the present invention includes an anode vacuum container 1. A cathode 2 is disposed along the central axis of container 1. An antenna 3 extracts microwaves generated in a hollow manner. The magnetron further includes an antenna ceramic 4 and cathode supports 5*a*, 5*b*.

Anode vacuum container 1 includes a cylindrical anode cylinder 6. A plurality of vanes 7 are arranged radially inside anode cylinder 6. Magnetic pieces 8, 9 are disposed at the upper and lower openings of anode cylinder 6. Metal containers 10, 11 cover the upper surfaces of magnetic pieces 8, 9.

Cathode 2 includes an end hat 12 secured to the end of cathode support 5*a*. A top hat 13 is secured to the end of cathode support 5*b*, which passes through end hat 12. A filament 14 is wrapped around cathode support 5*b* between top hat 13 and end hat 12.

Thin end section sections 6*a*, projecting from the ends of the upper and lower openings of anode cylinder 6, are tightly welded to outer perimeter bends 10*a*, 11*a* of metal containers 10, 11. This forms a tight bond between metal containers 10, 11 and anode cylinder 6.

Next, the procedure for tightly welding outer perimeter bends 10*a*, 11*a* of thin end sections 6*a* will be described. To facilitate the discussion, the tight welding between thin end section 6*a*, projecting from the end of the upper opening of anode cylinder 6, to outer perimeter bend 10*a* will be described.

Figure 2A:
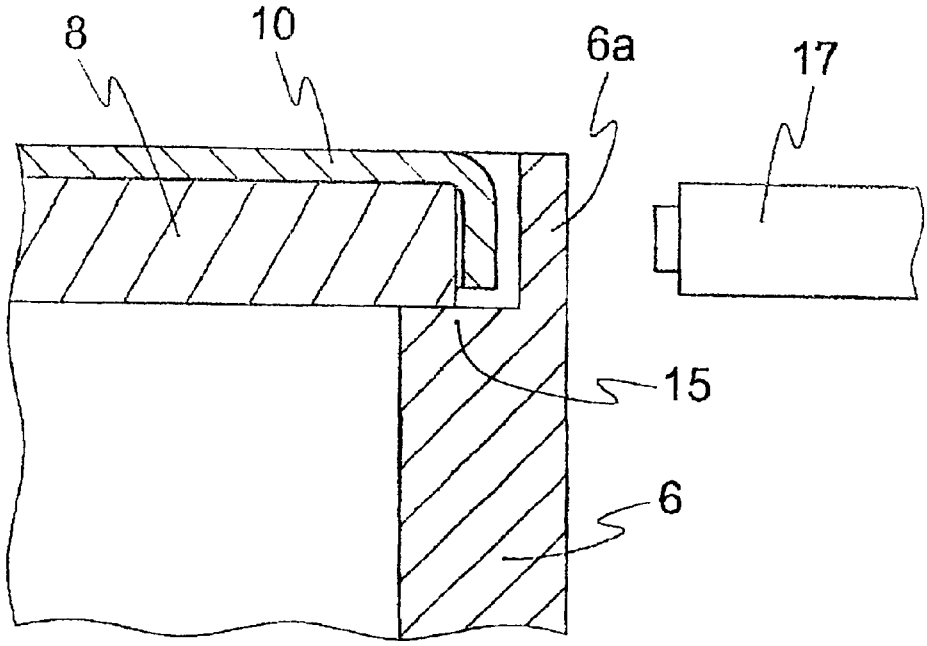
FIG. 2(*a*) is a schematic cross-section drawing showing a magnetron, according to the present invention, before elements are loosely secured.
Figure 2B:
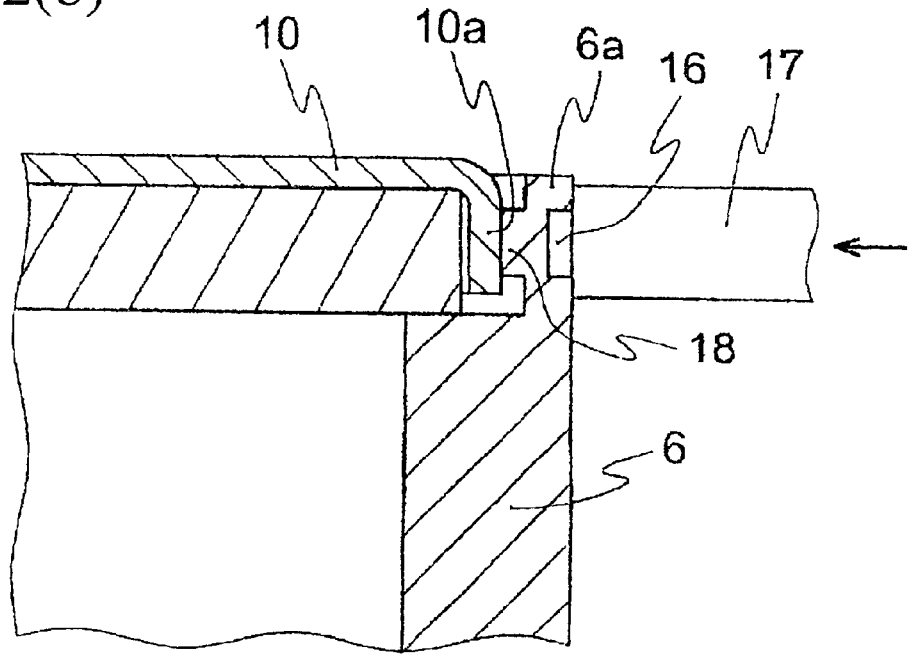

Referring now to FIG. 2(*a*), anode cylinder 6 is prepared as a cylindrical material with upper and lower openings from the ends of which are projected ring-shaped thin end sections 6*a*. Magnetic piece 8 and metal container 10, having a bent outer perimeter, are placed, in that order, on a shelf 15, formed on the inner side of thin end section 6*a*. Then, a projection tool 17, on which a projection 16 having a predetermined shape, is placed at the outer side of anode cylinder 6, opposite from thin end section 6*a*.

Referring to FIG. 2(*b*), projection tool 17 is impacted on thin end section 6*a* of anode cylinder 6, forming an inward projection 18 on thin end section 6*a*. Inward projection 18 abuts outer perimeter bend 10*a*. It would be desirable to form at least three inward projections 18 along the perimeter so that metal container 10 stays centered. Next, thin end section 6*a* and outer bend 10*a* are tightly welded together. This tight welding is performed, for example, by using electron beam welding.

In this embodiment of the present invention, the tight welding operation is performed by loosely securing metal container 10 using projection 18 of thin end section 6*a*. This prevents metal container 10 from becoming off-center, allowing accurate welding of metal container 10 to thin end section 6*a*. As a result, a tight seal is formed and maintained between anode cylinder 6 and metal container 10. Metal container 10 is supported by laterally projecting projection 18. Metal container 10 is loosely secured in a reliable manner even if the end surface of projection 18, formed on thin end section 6*a*, is positioned lower than the upper surface of metal container 10. As a result, the metal container is loosely secured even without increasing the height of anode cylinder 6. This reduces the material costs for anode cylinder 6.

In this embodiment of the present invention, the projection is formed by first positioning the magnetic piece and the metal container and then using the projection tool placed outside the thin end section of the anode cylinder. However, the present invention is not restricted to this specific embodiment. It would also be possible, for example, to first place the magnetic piece at an open end of the anode cylinder, on which is formed a predetermined inward projection positioned opposite from the thin end section. Then, the metal container would be positioned, and the outer perimeter bend of the metal container would be pressed into the projection, thus assembling the elements before making the tight weld.

Figure 3A:
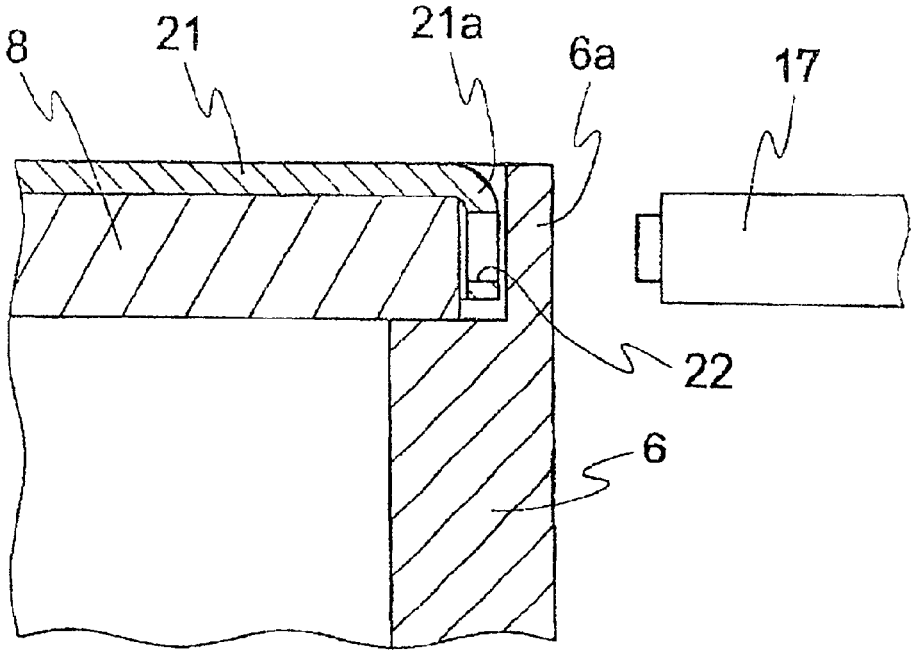
FIG. 3(*a*) shows a state of a magnetron, according to another embodiment of the present invention, before elements are loosely secured.
Figure 3B:
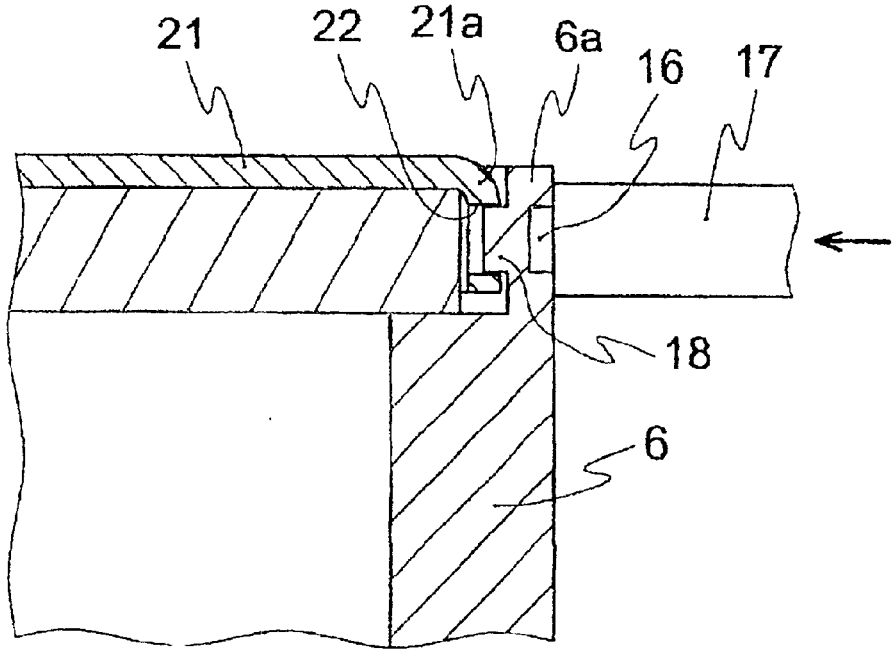
Figure 4:
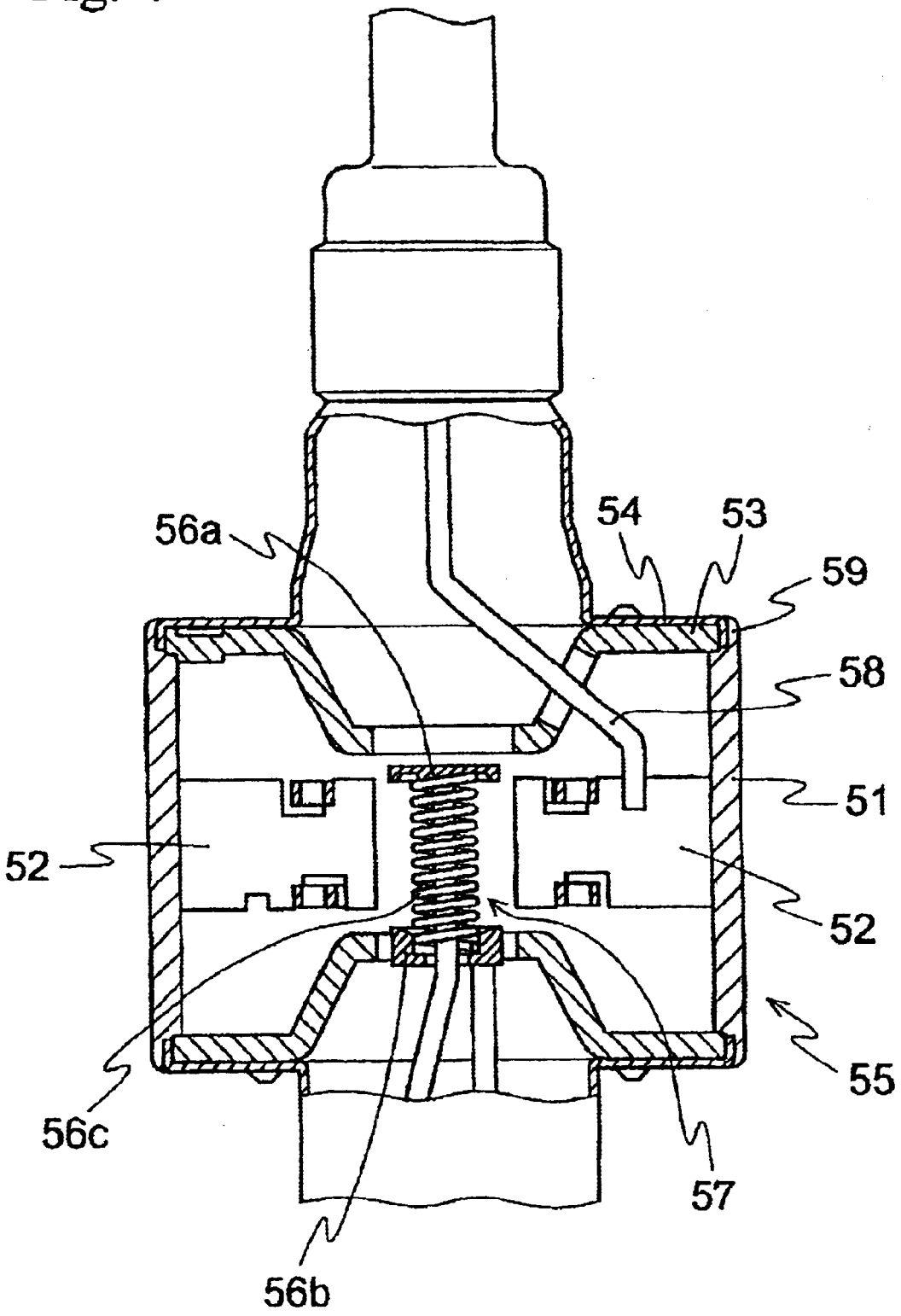
FIG. 4 is a schematic cross-section drawing showing an example of a conventional magnetron.
Figure 5A:
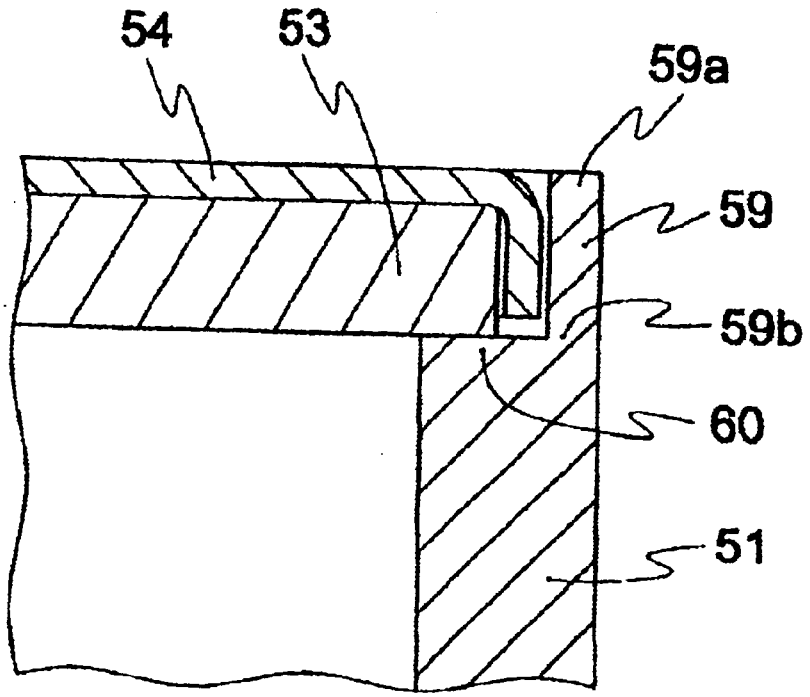
Fig. 5(a) PRIOR ART
FIG. 5(*a*) is a cross-section drawing of a conventional magnetron before tight welding is performed.
Figure 5B:
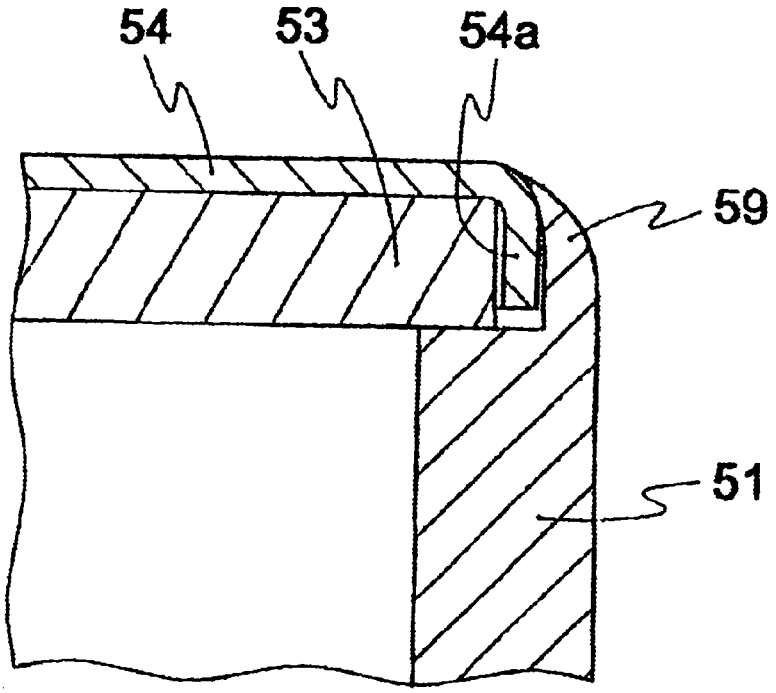
Fig. 5(b) PRIOR ART

Referring now to FIG. 3(*a*), it is also possible to place, on the opening of anode cylinder 6, magnetic piece 8 and a metal container 21, on which is formed a predetermined number of holes 22 along outer perimeter bend 21*a*. Then, projection tool 17 is placed outside of anode cylinder 6, opposite from thin end section 6*a*.

Referring to FIG. 3(*b*), projection tool 17 is aligned with hole 22 and impacted against thin end section 6*a* of anode cylinder 6. Thin end section 6*a* forms inward projection 18. Inward projection 18 is inserted into hole 22. It is desirable to have at least three inward projections 18 and holes 22 engaged at the same time along the perimeter so that metal container 21 stays centered. Then, thin end section 6*a* and outer perimeter bend 21*a* are tightly welded.

In this embodiment of the present invention, inward projection 18 of thin end section 6*a* loosely secures metal container 21, thus keeping metal container 21 centered, allowing accurate welding of thin end section 6*a* and metal container 21. This provides a tight bond between anode cylinder 6 and metal container 21. Metal container 21 is supported by laterally projecting inward projection 18. Thus, as with the embodiment described above, loose securing is achieved without increasing the height of anode cylinder 6. As a result, the material costs for anode cylinder 6 are reduced.

In these embodiments, the outer perimeter bend of the metal container is loosely secured by a predetermined number of projections projecting inward from the thin end section of the anode cylinder. The present invention is not restricted to this, however, and it would also be possible to loosely secure the outer perimeter bend of the metal container using a ring-shaped projection projecting inward from the thin end section of the anode cylinder.

As described above, the present invention allows improved welding for the assembly of the main magnetron unit. Additional, the present invention provides a tight bond between the anode cylinder and the metal container.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A method for making a magnetron wherein said magnetron comprises:

an anode cylinder;

a plurality of vanes arranged radially within said anode cylinder;

a magnetic piece disposed at an open end section of said anode cylinder;

an anode vacuum container, including a metal container covering an upper surface of said magnetic piece;

a cathode disposed along a central axis of said vacuum container; and an antenna externally discharging microwaves;

said method having steps comprising:

placing said magnetic piece and said metal container, in that order, on a shelf formed inwardly on a thin end section projecting from said open end section of said anode cylinder;

forming a predetermined number of projections projecting inwardly from said thin end section of said anode cylinder, whereby said metal container is loosely secured; and tightly welding said thin end section with said metal container.

2. The method for making magnetrons as described in claim 1, wherein an outer perimeter of said metal container is bent inward to form an outer perimeter bend, covering a substantial section of end portions of said magnetic piece.

3. The method for making magnetrons as described in claim 2, wherein said predetermined number of projections are formed after said metal piece and said metal container have been installed by using a projection tool disposed outside said thin end section of said anode cylinder.

4. The method for making magnetrons as described in claim 3, wherein said predetermined number of projections are inserted into a predetermined number of holes disposed on said outer perimeter bend of said metal container.

5. The method for making magnetrons as described in claim 2, wherein:

said predetermined number of projections are fanned before said metal container is installed; and loosely securing said metal container by pushing said outer perimeter bend of said metal container into said predetermined number of projections.

6. The method for making magnetrons as described in claim 5, wherein said predetermined number of projections are inserted into a predetermined number of holes disposed on said outer perimeter bend of said metal container.

7. The method for making magnetrons as described in claim 2, wherein said predetermined number of projections are inserted into a predetermined number of holes disposed on said outer perimeter bend of said metal container.

8. The method for making magnetrons as described in claim 2, wherein an end surface of said thin end section formed as a projection is formed lower than an upper surface of said metal container.

9. The method for making magnetrons as described in claim 8, wherein said predetermined number of projections are inserted into a predetermined number of holes disposed on said outer perimeter bend of said metal container.

10. A method for making magnetrons including, said magnetrons comprising:

an anode cylinder;

a plurality of vanes arranged radially within said anode cylinder;

a magnetic piece disposed at an open end section of said anode cylinder;

an anode vacuum container including a metal container disposed to cover an upper surface of said magnetic piece;

a cathode disposed along a central axis of said vacuum container; and an antenna externally discharging microwaves;

said method having steps comprising:

placing said magnetic piece and said metal container, in that order, on a shelf formed inwardly on a thin end section projecting from said open end section of said anode cylinder; and forming a substantially ring-shaped projection, projecting inwardly from said thin end section of said anode cylinder, whereby said metal container is loosely secured; and tightly welding said thin end section with said metal container.

11. The method for making magnetrons as described in claim 10, wherein an outer perimeter of said metal container is bent inward to form an outer perimeter bend, covering a substantial section of end portions of said magnetic piece.

12. The method for making magnetrons as described in claim 11, wherein said ring-shaped projection is formed after said magnetic piece and said metal container have been installed by using a projection tool disposed outside said thin end section of said anode cylinder.

13. The method for making magnetrons as described in claim 12, wherein an end surface of said thin end section formed as a projection is formed lower than an upper surface of said metal container.

14. The method for making magnetrons as described in claim 11, wherein an end surface of said thin end section formed as a projection is formed lower than an upper surface of said metal container.

15. The method for making magnetrons as described in claim 11, wherein:

said ring-shaped projections is formed before said metal container is installed; and loosely securing said metal container by pushing said outer perimeter bend of said metal container into said ring-shaped projection.

16. The method for making magnetrons as described in claim 15, wherein an end surface of said thin end section formed as a projection is formed lower than an upper surface of said metal container.

17. A method for making a magnetron wherein said magnetron comprises:

an anode cylinder;

a plurality of vanes arranged radially within said anode cylinder;

a magnetic piece disposed at an open end section of said anode cylinder;

an anode vacuum container, including a metal container covering an upper surface of said magnetic piece;

a cathode disposed along a central axis of said vacuum container; and an antenna externally discharging microwaves;

said method having steps comprising:

bending inward an outer perimeter of said metal container to form an outer perimeter bend for covering a substantial section of end portions of said magnetic piece;

placing said magnetic piece and said metal container, in that order, on a shelf formed inwardly on a thin end section projecting from said open end section of said anode cylinder;

forming a predetermined number of projections projecting inwardly from said thin end section of said anode cylinder before said metal container is installed;

loosely securing said metal container by pushing said outer perimeter bend of said metal container into said predetermined number of projections; and tightly welding said thin end section with said metal container.

18. A method for making magnetrons including, said magnetrons comprising:

an anode cylinder;

a plurality of vanes arranged radially within said anode cylinder;

a magnetic piece disposed at an open end section of said anode cylinder;

an anode vacuum container including a metal container disposed to cover an upper surface of said magnetic piece;

a cathode disposed along a central axis of said vacuum container; and an antenna externally discharging microwaves;

said method having steps comprising:

bending inward an outer perimeter of said metal container to form an outer perimeter bend for covering a substantial section of end portions of said magnetic piece;

placing said magnetic piece and said metal container, in that order, on a shelf formed inwardly on a thin end section projecting from said open end section of said anode cylinder; and forming a substantially ring-shaped projection before said metal container is installed, projecting inwardly from said thin end section of said anode cylinder;

loosely securing said metal container by pushing said outer perimeter bend of said metal container into said ring-shaped projection; and tightly welding said thin end section with said metal container.

* * * * *